US011250746B2

(12) United States Patent
Zhou et al.

(10) Patent No.: US 11,250,746 B2
(45) Date of Patent: Feb. 15, 2022

(54) DISPLAY APPARATUS AND CONTROL METHOD THEREOF

(71) Applicants: BEIJING BOE DISPLAY TECHNOLOGY CO., LTD., Beijing (CN); BOE TECHNOLOGY GROUP CO., LTD., Beijing (CN)

(72) Inventors: Xing Zhou, Beijing (CN); Guangdong Shi, Beijing (CN); Kun Lu, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/959,274

(22) PCT Filed: Dec. 25, 2019

(86) PCT No.: PCT/CN2019/128438
§ 371 (c)(1),
(2) Date: Jun. 30, 2020

(87) PCT Pub. No.: WO2020/177457
PCT Pub. Date: Sep. 10, 2020

(65) Prior Publication Data

US 2021/0074192 A1 Mar. 11, 2021

(30) Foreign Application Priority Data

Mar. 4, 2019 (CN) ..... 201910160274.X

(51) Int. Cl.
*G09G 3/00* (2006.01)
*G09G 3/32* (2016.01)

(52) U.S. Cl.
CPC ..... *G09G 3/006* (2013.01); *G09G 3/32* (2013.01); *G09G 2310/0267* (2013.01);
(Continued)

(58) Field of Classification Search
CPC .. G09G 3/006; G09G 3/32; G09G 2310/0267; G09G 2310/0275; G09G 2320/0295; G09G 2330/12
See application file for complete search history.

(56) References Cited

U.S. PATENT DOCUMENTS 6,717,648 B2 4/2004 Tsukao
8,212,751 B2 * 7/2012 Hwang ..... G09G 3/20 345/87
(Continued)

FOREIGN PATENT DOCUMENTS

CN 102595061 A 7/2012
CN 103595935 A 2/2014
(Continued)

OTHER PUBLICATIONS

Office Action dated Mar. 2, 2020 in corresponding Chinese Application No. 201910160274.X, with English translation.
(Continued)

*Primary Examiner* — Amare Mengistu
*Assistant Examiner* — Jennifer L Zubajlo
(74) *Attorney, Agent, or Firm* — McDermott Will & Emery LLP

(57) ABSTRACT

The display apparatus includes a plurality of sub-pixels. The control method includes: calculating a compensation data signal of each compensation sub-pixel according to a position of at least one dead sub-pixel adjacent to the compensation sub-pixel in the display apparatus, a data signal of each dead sub-pixel adjacent to the compensation sub-pixel in a current frame image, and a number of compensation
(Continued)

sub-pixels in all sub-pixels that have a same emission color as and are adjacent to each dead sub-pixel; calculating a total data signal for the compensation sub-pixel according to a data signal of the compensation sub-pixel in the current frame image and the calculated compensation data signal of the compensation sub-pixel; and inputting the total data signal to the compensation sub-pixel when the current frame image is displayed.

10 Claims, 4 Drawing Sheets

(52) U.S. Cl.
CPC ..... *G09G 2310/0275* (2013.01); *G09G 2320/0295* (2013.01); *G09G 2330/12* (2013.01)

(56) References Cited

U.S. PATENT DOCUMENTS

2001/0050730 A1 12/2001 Tsukao
2004/0047023 A1 3/2004 Sandstrom
2011/0227958 A1* 9/2011 Park ..... G09G 3/20 345/690
2012/0182452 A1 7/2012 Yasuma
2015/0187249 A1 7/2015 Tani et al.
2020/0013326 A1 1/2020 Zheng et al.

FOREIGN PATENT DOCUMENTS

CN 104752635 A 7/2015
CN 105528993 A * 4/2016
CN 105528993 A 4/2016
CN 106898286 A 6/2017
CN 109686302 A 4/2019
JP 2001356364 A 12/2001

OTHER PUBLICATIONS

Office Action dated Sep. 3, 2020 in corresponding Chinese Application No. 201910160274.X, with English translation.

* cited by examiner

DISPLAY APPARATUS AND CONTROL METHOD THEREOF

CROSS-REFERENCE TO RELATED APPLICATIONS

This application is a national phase entry under 35 USC 371 of International Patent Application No. PCT/CN2019/128438 filed on Dec. 25, 2019, which claims priority to Chinese Patent Application No. 201910160274.X filed Mar. 4, 2019, which are incorporated herein by reference in their entirety.

TECHNICAL FIELD

The present disclosure relates to the field of display technologies, and in particular, to a display apparatus and a control method thereof.

BACKGROUND

Currently, display apparatuses generally have a problem of dark spots during display. In an example where a display apparatus is a micro light-emitting diode (Micro-LED) display apparatus, due to lattice matching, a plurality of Micro-LEDs must be grown on a donor substrate (e.g., a sapphire substrate) firstly by a molecular beam epitaxy technique during a process of manufacturing the Micro-LED display apparatus, and then the Micro-LEDs are transferred to a circuit substrate. Since a size of the circuit substrate is much larger than that of the donor substrate, it is necessary to transfer Micro-LEDs multiple times. In a process of transferring millions of Micro-LEDs, phenomena such as unsuccessful transfer of individual Micro-LEDs and damage of Micro-LEDs may easily occur. Since a size of a Micro-LED is very small, and a gap between Micro-LEDs is also very small (up to the micron level), it is difficult and complicated to repair positions where Micro-LEDs fail to be transferred or Micro-LEDs are damaged. As a result, in a case where the Micro-LED display apparatus displays an image, dark spots (also called dead pixels) will occur at positions where Micro-LEDs fail to be transferred or Micro-LEDs are damaged, thereby affecting the display of the Micro-LED display apparatus.

SUMMARY

In one aspect, a control method of a display apparatus is provided. The display apparatus includes a plurality of sub-pixels. The control method includes:

calculating a compensation data signal of each compensation sub-pixel according to a position of at least one dead sub-pixel adjacent to the compensation sub-pixel in the display apparatus, a data signal of each dead sub-pixel adjacent to the compensation sub-pixel in a current frame image, and a number of compensation sub-pixels in all sub-pixels that have a same emission color as and are adjacent to each dead sub-pixel, wherein the compensation sub-pixel is configured to compensate for luminance lost by the at least one dead sub-pixel adjacent thereto when the current frame image is displayed; and calculating a total data signal for the compensation sub-pixel according to a data signal of the compensation sub-pixel in the current frame image and the calculated compensation data signal of the compensation sub-pixel; and inputting the total data signal to the compensation sub-pixel when the current frame image is displayed.

In some embodiments, the control method further includes: before calculating a compensation data signal of each compensation sub-pixel according to a position of at least one dead sub-pixel adjacent to the compensation sub-pixel in the display apparatus, a data signal of each dead sub-pixel adjacent to the compensation sub-pixel in the current frame image, and the number of compensation sub-pixels in all sub-pixels that have the same emission color as and are adjacent to each dead sub-pixel, detecting the plurality of sub-pixels separately to determine whether each sub-pixel of the plurality of sub-pixels is able to emit light; and if the sub-pixel is not able to emit light, determining that the corresponding sub-pixel is a dead sub-pixel and storing a position of the dead sub-pixel.

In some embodiments, the display apparatus includes a plurality of gate lines and a plurality of data lines. Detecting the plurality of sub-pixels separately to determine whether each sub-pixel of the plurality of sub-pixels is able to emit light, includes: inputting a scanning signal to the plurality of gate lines row by row; when the scanning signal is input to each gate line of the plurality of gate lines, inputting a detection signal to a signal input terminal of each data line of the plurality of data lines, and detecting whether a current exists on the corresponding data line; if a current exists on the data line, determining that a sub-pixel controlled by the gate line and the data line is able to emit light; and if no current exists on the data line, determining that the sub-pixel controlled by the gate line and the line is not able to emit light.

In some embodiments, the control method further includes: detecting the plurality of sub-pixels separately at a set time to obtain a position of each dead sub-pixel in the display apparatus, and updating the position of each dead sub-pixel stored previously with a position of each dead sub-pixel detected newly.

In some embodiments, the display apparatus is a micro light-emitting diode (Micro-LED) display apparatus, a mini light-emitting diode (Mini-LED) display apparatus or an electroluminescent display apparatus, and the data signal is a current signal.

In some embodiments, calculating a compensation data signal of each compensation sub-pixel according to a position of at least one dead sub-pixel adjacent to the compensation sub-pixel in the display apparatus, a data signal of each dead sub-pixel adjacent to the compensation sub-pixel in a current frame image, and a number of compensation sub-pixels in all sub-pixels that have a same emission color as and are adjacent to each dead sub-pixel, includes: calculating a compensation data signal of each compensation sub-pixel according to a position of a single dead sub-pixel adjacent to the compensation sub-pixel in the display apparatus, a data signal of the single dead sub-pixel adjacent to the compensation sub-pixel in a current frame image, and a number of compensation sub-pixels in all sub-pixels that have a same emission color as and are adjacent to the single dead sub-pixel; or calculating a compensation data signal of each compensation sub-pixel according to a position of each of a plurality of dead sub-pixels adjacent to the compensation sub-pixel in the display apparatus, a data signal of each of the plurality of dead sub-pixels adjacent to the compensation sub-pixel in a current frame image, and a number of compensation sub-pixels in all sub-pixels that have a same emission color as and are adjacent to each dead sub-pixel.

In some embodiments, in a case where the compensation sub-pixel compensates for the luminance lost by a single dead sub-pixel that is adjacent to and has the same color as the compensation sub-pixel, calculating a compensation data signal of each compensation sub-pixel according to a position of a single dead sub-pixel adjacent to the compensation sub-pixel in the display apparatus, a data signal of the single dead sub-pixel adjacent to the compensation sub-pixel in a current frame image, and a number of compensation sub-pixels in all sub-pixels that have a same emission color as and are adjacent to the single dead sub-pixel, includes: calculating the compensation data signal of the compensation sub-pixel by dividing a current signal of the single dead sub-pixel in the current frame image by the number of compensation sub-pixels that compensate for the luminance lost by the single dead sub-pixel.

In some embodiments, in a case where the compensation sub-pixel compensates for the luminance lost by a plurality of dead sub-pixels that are adjacent to and have the same color as the compensation sub-pixel, calculating a compensation data signal of each compensation sub-pixel according to a position of each of a plurality of dead sub-pixels adjacent to the compensation sub-pixel in the display apparatus, a data signal of each of the plurality of dead sub-pixels adjacent to the compensation sub-pixel in a current frame image, and a number of compensation sub-pixels in all sub-pixels that have a same emission color as and are adjacent to each dead sub-pixel, includes: for each dead sub-pixel adjacent to the compensation sub-pixel, obtaining a quotient of a current signal of the dead sub-pixel in the current frame image and the number of compensation sub-pixels that compensate for the luminance lost by the dead sub-pixel; and calculating a compensation data signal of the compensation sub-pixel by adding up quotients for the plurality of dead sub-pixels adjacent to the compensation sub-pixel.

In some embodiments, calculating a total data signal for the compensation sub-pixel according to a data signal of the compensation sub-pixel in the current frame image and the calculated compensation data signal of the compensation sub-pixel, includes: calculating the total data signal of the compensation sub-pixel by adding up the data signal of the compensation sub-pixel in the current frame image and the calculated compensation data signal of the compensation sub-pixel.

In another aspect, a display apparatus is provided. The display apparatus includes a display panel and a processor. The display panel includes a plurality of sub-pixels. The processor is configured to: calculate a compensation data signal of each compensation sub-pixel according to a position of at least one dead sub-pixel adjacent to the compensation sub-pixel in the display apparatus, a data signal of each dead sub-pixel adjacent to the compensation sub-pixel in a current frame image, and a number of compensation sub-pixels in all sub-pixels that have a same emission color as and are adjacent to each dead sub-pixel of the at least one dead sub-pixel, wherein the compensation sub-pixel is configured to compensate for luminance lost by the at least one dead sub-pixel adjacent thereto when the current frame image is displayed; and calculate a total data signal for each compensation sub-pixel according to a data signal of the compensation sub-pixel in the current frame image and the calculated compensation data signal of the compensation sub-pixel, and input the total data signal to the compensation sub-pixel when the current frame image is displayed.

In some embodiments, the display apparatus further includes: a detector and a memory. The detector is configured to: detect the plurality of sub-pixels separately to determine whether each sub-pixel of the plurality of sub-pixels is able to emit light; and if the sub-pixel is not able to emit light, determine that the corresponding sub-pixel is a dead sub-pixel. The memory is coupled to the detector, and the memory is configured to store a position of the dead sub-pixel.

In some embodiments, the display panel includes a plurality of gate lines and a plurality of data lines. The detector is configured to: input a scanning signal to the plurality of gate lines row by row; when the scanning signal is input to each gate line of the plurality of gate lines, input a detection signal to a signal input terminal of each data line of the plurality of data lines, and detect whether a current exists on the corresponding data line; if a current exists on the data line, determine that a sub-pixel controlled by the gate line and the data line is able to emit light; and if no current exists on the data line, determine that the sub-pixel controlled by the gate line and the data line is not able to emit light.

In some embodiments, the display apparatus further includes a controller. The controller is configured to control the detector to be turned on or off.

In yet another aspect, a non-transitory computer-readable storage medium is provided. The computer-readable storage medium has stored therein computer program instructions that, when executed by a processor, cause the processor to perform one or more steps in the control method of the display apparatus as described in any one of the above embodiments.

BRIEF DESCRIPTION OF THE DRAWINGS

In order to describe technical solutions in the present disclosure more clearly, accompanying drawings to be used in some embodiments of the present disclosure will be introduced briefly. Obviously, the accompanying drawings to be described below are merely accompanying drawings of some embodiments of the present disclosure, and a person of ordinary skill in the art can obtain other drawings according to these drawings. In addition, accompanying drawings in the following description may be regarded as schematic diagrams, and are not limitations on an actual size of a product, an actual process of a method and an actual timing of signals that embodiments of the present disclosure relate to.

DETAILED DESCRIPTION

Technical solutions in some embodiments of the present disclosure will be described clearly and completely with reference to accompanying drawings. Obviously, the described embodiments are merely some but not all of the embodiments of the present disclosure. All other embodiments obtained on a basis of the embodiments of the present disclosure by a person of ordinary skill in the art shall be included in the protection scope of the present disclosure.

Unless the context requires otherwise, the term "comprise" and other forms thereof such as the third-person singular form "comprises" and the present participle form "comprising" in the description and the claims are construed as an open and inclusive meaning, i.e., "included, but not limited to". In the description of the specification, terms such as "one embodiment", "some embodiments", "exemplary embodiments", "example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials or characteristics may be included in any one or more embodiments or examples in any suitable manner.

In the description of the embodiments of the present disclosure, the term "a plurality of" means two or more unless otherwise specified.

Some embodiments may be described using the expression "coupled" and "connected" along with their derivatives. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled" or "communicatively coupled", however, may also mean that two or more elements are not in direct contact with each other, but yet still cooperate or interact with each other. The embodiments disclosed herein are not necessarily limited in this context.

The expression "At least one of A, B, and C" has a same meaning as the expression "at least one of A, B, or C", and both include the following combinations of A, B, and C: only A, only B, only C, a combination of A and B, a combination of A and C, a combination of B and C, and a combination of A, B, and C.

Figure 1:
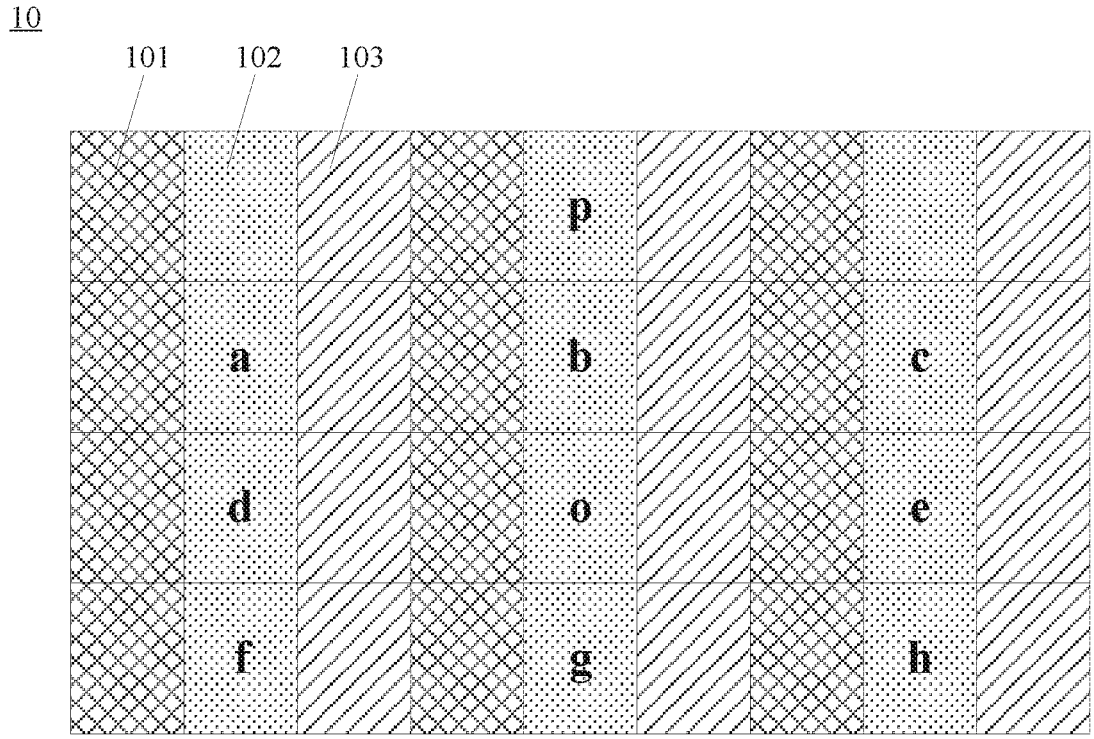
FIG. 1 is a structural diagram of a display apparatus, in accordance with some embodiments.

Some embodiments of the present disclosure provide a display apparatus. As shown in FIG. 1, the display apparatus 10 includes a plurality of sub-pixels. In some embodiments, the plurality of sub-pixels include sub-pixels with at least one color of red, green and blue. In some other embodiments, the plurality of sub-pixels include sub-pixels with at least one color of red, green, blue and white.

It will be noted that, FIG. 1 illustrates an example in which the plurality of sub-pixels in the display apparatus 10 include red sub-pixels 101, green sub-pixels 102, and blue sub-pixels 103.

In addition, the plurality of sub-pixels in the display apparatus 10 are arranged in order according to a certain arrangement manner. For example, as shown in FIG. 1, the plurality of sub-pixels are arranged in an array in such a manner that a column of red sub-pixels 101, a column of green sub-pixels 102 and a column of blue sub-pixels 103 are arranged repeatedly in this order.

In some embodiments, the display apparatus is a liquid crystal display (LCD) apparatus. In some other embodiments, the display apparatus is a micro light-emitting diode (Micro-LED) display apparatus or a mini light-emitting diode (Mini-LED) display apparatus. In yet some other embodiments, the display apparatus is an electroluminescent display apparatus. In a case where the display apparatus is the electroluminescent display apparatus, the display apparatus may be an organic light-emitting diode (OLED) display apparatus or a quantum dot light-emitting diode (QLED) display apparatus. Some embodiments of the present disclosure do not limit the type of the display apparatus.

Figure 2:
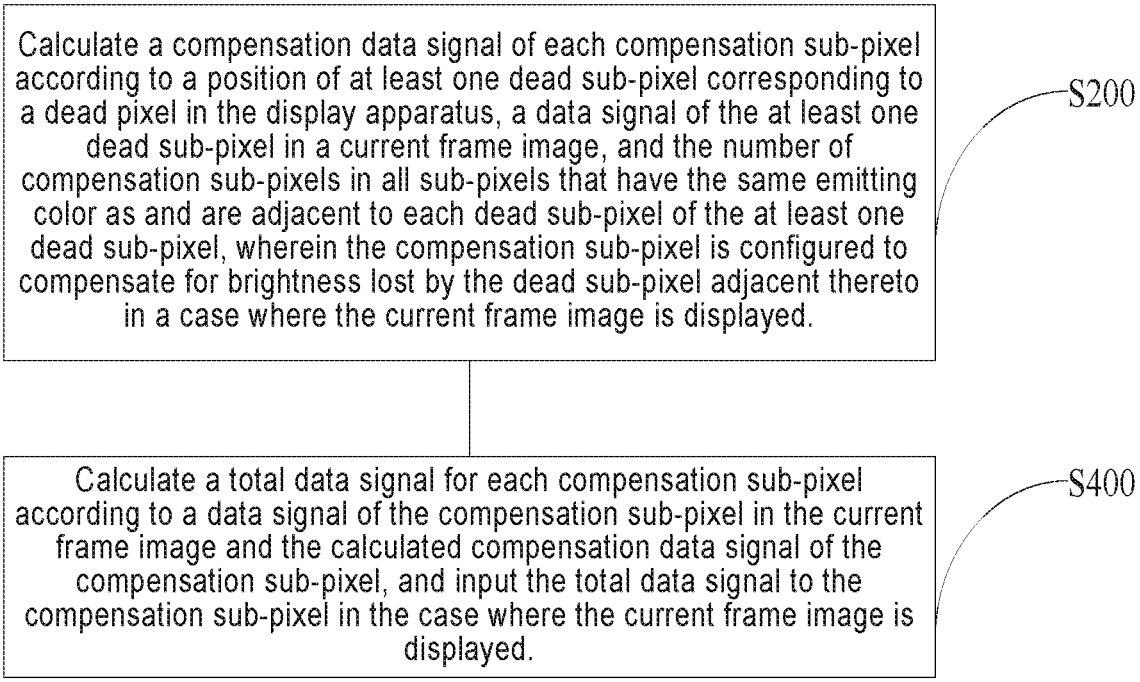
FIG. 2 is a flow diagram of a control method of a display apparatus, in accordance with some embodiments.

Some embodiments of the present disclosure provide a control method of the display apparatus, and as shown in FIG. 2, the control method includes step 200 (S200) and step 400 (S400).

In some embodiments, in S200, a compensation data signal of each compensation sub-pixel is calculated according to a position of at least one dead sub-pixel in the display apparatus, a data signal of the at least one dead sub-pixel in a current frame image, and the number of compensation sub-pixels in all sub-pixels that have the same emission color as and are adjacent to each dead sub-pixel. The compensation sub-pixel is configured to compensate for luminance lost by the dead sub-pixel adjacent thereto when the current frame image is displayed.

It will be noted that a dead spot refers to a position on the display apparatus at which an image is not displayed, and a dead sub-pixel refers to a sub-pixel that is not able to display an image.

In some embodiments, positions of all sub-pixels that have the same emission color as and are adjacent to each dead sub-pixel may be obtained according to a position of the dead sub-pixel corresponding to a dead spot in the display apparatus. All sub-pixels that have the same emission color as and are adjacent to the dead sub-pixel refer to all sub-pixels that have the same emission color as the dead sub-pixel and are located around and proximate to the dead sub-pixel.

For example, referring to FIG. 1, the sub-pixel o is a dead sub-pixel, and all sub-pixels that have the same emission color as and are adjacent to the dead sub-pixel o include sub-pixels a, b, c, d, e, f, g and h.

It will be noted that the compensation sub-pixel cannot be a dead sub-pixel, and the compensation sub-pixel should be display an image normally.

In some embodiments, there is no limitation on compensation sub-pixels in all sub-pixels that have the same emission color as and are adjacent to the dead sub-pixel and the number of the compensation sub-pixels, and one or more sub-pixels in all sub-pixels that have the same emission color as and are adjacent to the dead sub-pixel may be selected as compensation sub-pixels as required.

For example, referring to FIG. 1, in the example where the sub-pixel o is a dead sub-pixel, none of sub-pixels a, b, c, d, e, f, g and h that have the same emission color as and are adjacent to the dead sub-pixel o is a dead sub-pixel. For example, sub-pixels b and g are selected as compensation sub-pixels. For another example, sub-pixels b, g, d and e are selected as compensation sub-pixels. For yet another example, sub-pixels a, b, c, d, e, f, g and h are selected as compensation sub-pixels.

In some embodiments, in a case where the number of compensation sub-pixels in all sub-pixels that have the same emission color as and are adjacent to a dead sub-pixel is greater than 1, a compensation data signal of each compensation sub-pixel compensating for the luminance lost by the dead sub-pixel may be equal or unequal, which is not limited in some embodiments of the present disclosure.

For example, as shown in FIG. 1, the sub-pixel o is a dead sub-pixel, and the sub-pixels b and g in all sub-pixels that have the same emission color as and are adjacent to the dead sub-pixel o are compensation sub-pixels. The compensation sub-pixels b and g compensate for the luminance lost by the dead sub-pixel o, and compensation data signals of the compensation sub-pixels b and g compensating the dead sub-pixel may be equal or unequal.

In some embodiments, in a case where the number of compensation sub-pixels in all sub-pixels that have the same emission color as and are adjacent to a dead sub-pixel is greater than 1, and a compensation data signal of each compensation sub-pixel compensating for the luminance lost by the dead sub-pixel is equal, a method of calculating the compensation data signal of each compensation sub-pixel is relatively simple.

In some embodiments, in S400, a total data signal for each compensation sub-pixel is calculated according to a data signal of the compensation sub-pixel in the current frame image and the calculated compensation data signal of the compensation sub-pixel, and the total data signal is input to the compensation sub-pixel when the current frame image is displayed.

It will be understood that each sub-pixel in each frame image corresponds to a data signal when the display apparatus displays an image.

Herein, when the current frame image is displayed, the calculated total data signal for each compensation sub-pixel is input to the compensation sub-pixel, and data signals corresponding to the frame image are input to the other sub-pixels excluding compensation sub-pixels and the dead sub-pixel in the plurality of sub-pixels.

In some embodiments, since luminance and current are in a linear relationship, in a case where the data signal is a current signal, that "a total data signal for each compensation sub-pixel is calculated according to the data signal corresponding to the compensation sub-pixel in the current frame image and the calculated compensation data signal of the compensation sub-pixel" may be realized in a manner that the data signal corresponding to the compensation sub-pixel in the current frame image may be superimposed with the calculated compensation data signal of the compensation sub-pixel to obtain the total data signal for each compensation sub-pixel.

In some embodiments, when the display apparatus displays an image, in each frame image, the total data signal for each compensation sub-pixel in the current frame image is calculated according to the data signal corresponding to the compensation sub-pixel in the current frame image and the calculated compensation data signal of the compensation sub-pixel. When the current frame image is displayed, the total data signal is input to the compensation sub-pixel, and thus each frame image compensates for the luminance lost by the dead sub-pixel.

Some embodiments of the present disclosure provide the control method of the display apparatus, in which compensation sub-pixels in all sub-pixels that have the same emission color as and are adjacent to each dead sub-pixel are used to compensate for the luminance lost by the dead sub-pixel, thereby solving the problem that the dead pixel exists in the display apparatus to affect the display, and improving the display quality of the display apparatus.

On this basis, since a position of a dead pixel is not required to be repaired in some embodiments of the present disclosure, a repairing process is omitted, which greatly saves the repairing cost and time and simplifies the production process.

In some embodiments, when the 3200 is performed, the position of the dead sub-pixel corresponding to the dead spot in the display apparatus is directly obtained from a memory.

In some embodiments, before S200, the control method of the display apparatus further includes step 100 (S100).

In S100, the plurality of sub-pixels are detected separately to determine whether each sub-pixel of the plurality of sub-pixels is able to emit light. If not, it is determined that the sub-pixel is a dead sub-pixel, and the position of the dead sub-pixel is stored; and if yes, it is determined that the sub-pixel is a normal sub-pixel.

In some embodiments, the plurality of sub-pixels are detected separately, which may be a row-by-row detection of the plurality of sub-pixels, or a column-by-column detection of the plurality of sub-pixels.

In some embodiments, S100 may be performed after the display apparatus is turned on and before the display apparatus displays an image each time. Or the display apparatus is provided with a controller therein, and the controller may control whether to perform S100 as required.

In some embodiments, the control method of the display apparatus further includes: detecting the plurality of sub-pixels separately at a set time to obtain a position of each dead sub-pixel in the display apparatus, and updating the position of each dead sub-pixel stored previously with a position of each dead sub-pixel detected newly. The set time is after the display apparatus is turned on and before the display apparatus displays an image.

For example, before S100, if the memory has not stored the position of the dead sub-pixel, the plurality of sub-pixels are separately detected to obtain the position of the dead sub-pixel, and then the position of the dead sub-pixel is stored. Before S100, if the memory has stored the position of the dead sub-pixel, the plurality of sub-pixels are separately detected to obtain a position of each new dead sub-pixel, and then the position of the new dead sub-pixel will overwrite the position of the previous dead sub-pixel stored in the memory.

In some embodiments, there is no limitation as to which method is used to separately detect the plurality of sub-pixels to determine whether each sub-pixel is able to emit light.

Figure 3:
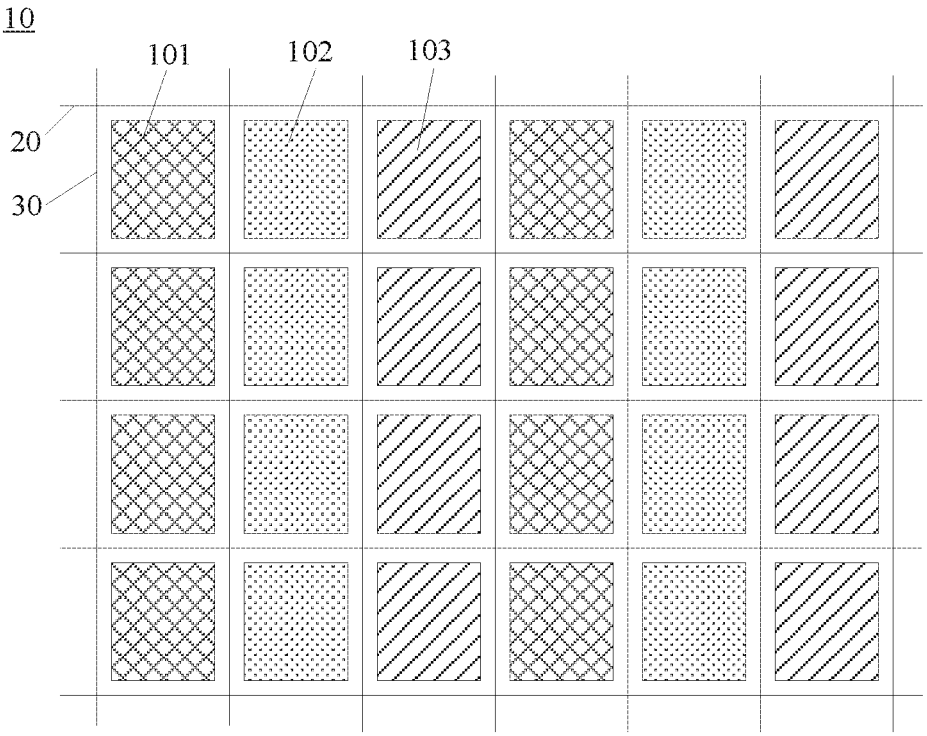
FIG. 3 is a structural diagram of another display apparatus, in accordance with some embodiments.

In some embodiments, as shown in FIG. 3, the display apparatus includes a plurality of gate lines 20 and a plurality of data lines 30. For example, the plurality of gate lines 20 and the plurality of data lines 30 cross.

In some embodiments, detecting the plurality of sub-pixels separately to determine whether each sub-pixel of the plurality of sub-pixels is able to emit light, includes: inputting scanning signals to the plurality of gate lines 20 row by row; and when the scanning signal is input to each gate line 20 of the plurality of gate lines 20, inputting a detection signal to a signal input terminal of each data line 30 of the plurality of data lines 30, and detecting whether a current exists on the corresponding data line 30. If a current exists, it is determined that a sub-pixel controlled by a corresponding gate line and a corresponding data line is able to emit light; and if no current exists, it is determined that the sub-pixel controlled by the corresponding gate line and the corresponding data line is not able to emit light.

For example, the detection signal is a current signal.

Herein, the sub-pixel controlled by the corresponding gate line and the corresponding data line refers to a sub-pixel electrically connected to the gate line and the data line. When a signal is input to the corresponding gate line, the data signal on the corresponding data line may be input to the sub-pixel.

On this basis, a current signal is input to the signal input terminal of the data line 30. If a current is detected to exist on the data line 30, the circuit is detected to be on, and thus the sub-pixel controlled by the gate line and the data line is able to emit light. If no current is detected to exist on the data line 30, that is, a current is not detected, the circuit is detected to be off, and thus the sub-pixel controlled by the gate line and the data line is not able to emit light. In an example where the display apparatus is a Micro-LED display apparatus, if the current on the data line 30 is able to be detected, the Micro-LED that is connected to the gate line and the data line is not damaged.

In some embodiments, when a signal is input to each gate line 20, a current signal may be input to the plurality of data lines 30 one by one, or a current signal may be input to the plurality of data lines 30 simultaneously.

In some embodiments, the display apparatus is the Micro-LED display apparatus or the electroluminescent display apparatus, and the data signal is the current signal.

In a case where the display apparatus is the Micro-LED display apparatus or the electroluminescent display apparatus, when the compensation sub-pixel compensates for luminance lost by one dead sub-pixel adjacent thereto, the compensation data signal of the compensation sub-pixel is $$\frac{A}{N}.$$

Where A is a current signal of the dead sub-pixel in the current frame image, and N is the number of compensation sub-pixels that compensate for the luminance lost by the dead sub-pixel.

For example, referring to FIG. 1, if the sub-pixel o is a dead sub-pixel, the compensation sub-pixels that compensate the dead sub-pixel o are compensation sub-pixels d, e, b and g, that is, the number N of compensation sub-pixels that compensate for the luminance lost by the dead sub-pixel o is 4. If a current signal of the dead sub-pixel o in the current frame image is A, and the compensation sub-pixel b only compensates the dead sub-pixel o, a compensation data signal of the compensation sub-pixel b is $$\frac{A}{4}.$$

If a data signal corresponding to the compensation sub-pixel b in the current frame image is B, a total data signal of the compensation sub-pixel b is a sum of B and $$\frac{A}{4}.$$

In some embodiments, in the case where the display apparatus is the Micro-LED display apparatus or the electroluminescent display apparatus, when the compensation sub-pixel compensates for luminance lost by a plurality of dead sub-pixels adjacent thereto, the compensation data signal of the compensation sub-pixel compensating for the luminance lost by each dead sub-pixel adjacent thereto is $$\frac{A}{4}.$$

The compensation data signal of the compensation sub-pixel is a sum of compensation data signals of the compensation sub-pixel compensating for the luminance lost by the dead sub-pixels adjacent thereto. Where A is a current signal of the each dead sub-pixel in the current frame image, and N is the number of compensation sub-pixels that compensate for the luminance lost by the each dead sub-pixel.

For example, one compensation sub-pixel may compensate two dead sub-pixels adjacent thereto. Referring to FIG. 1, the compensation sub-pixel b compensates the dead pixel sub-pixel o and the dead pixel sub-pixel p. If the current signal of the dead sub-pixel o in the current frame image is A1, the number of compensation sub-pixels that compensate for the luminance lost by the dead sub-pixel o is 4, and the compensation sub-pixels that compensate for the luminance lost by the dead sub-pixel o include the compensation sub-pixel b, the compensation data signal of the compensation sub-pixel b compensating for the luminance lost by the dead sub-pixel o is $$\frac{A1}{4}.$$

If a current signal of the dead sub-pixel p in the current frame image is A2, the number of compensation sub-pixels that compensate for luminance lost by the dead sub-pixel p is 2, and the compensation sub-pixels that compensate for the luminance lost by the dead sub-pixel p include the compensation sub-pixel b. The compensation data signal of the compensation sub-pixel b compensating for the luminance lost by the dead sub-pixel p is $$\frac{A2}{2}.$$

In summary, the compensation data signal of the compensation sub-pixel b is a sum of $$\frac{A1}{4} \text{ and } \frac{A2}{2}.$$

If the data signal corresponding to the compensation sub-pixel b in the current frame image is B, the total data signal of the compensation sub-pixel b is a sum of B, $$\frac{A1}{4} \text{ and } \frac{A2}{2}.$$

In some embodiments, the display apparatus is an LCD apparatus, and the data signal is a voltage signal.

In some embodiments, in a case where the display apparatus is the LCD apparatus, there is no limitation on a method of calculating the compensation data signal of each compensation sub-pixel according to a position of the dead sub-pixel corresponding to the dead spot in the display apparatus, a data signal of the dead sub-pixel in the current frame image, and the number of compensation sub-pixels in all sub-pixels that have the same emission color as and are adjacent to each dead sub-pixel, as long as the compensation sub-pixels are able to compensate for the luminance lost by the dead sub-pixel.

Herein, since different gray-scales have corresponding voltages, the dead sub-pixel in the current frame image also has a corresponding voltage signal, and according to the voltage signal of the dead sub-pixel in the current frame image and the number of compensation sub-pixels in all sub-pixels that have the same emission color as and are adjacent to each dead sub-pixel, a corresponding voltage may be obtained as the compensation voltage signal of the compensation sub-pixel through empirical results.

For example, the sub-pixel o is a dead sub-pixel, the number of compensation sub-pixels in all sub-pixels that have the same emission color as and are adjacent to the dead sub-pixel o is 4, and the compensation sub-pixels that compensate for the luminance lost by the dead sub-pixel o include the compensation sub-pixel b.

For example, if the luminance lost by the dead sub-pixel o in the current frame is 100 nits and an original luminance of the compensation sub-pixel b is 50 nits, a compensation luminance of the compensation sub-pixel b compensating the dead sub-pixel o is 25 nits, and after the original luminance of the compensation sub-pixel b plus the compensation luminance thereof, a final display luminance of the compensation sub-pixel b is 75 nits.

For another example, if the luminance lost by the dead sub-pixel o in the current frame image is 100 nits and the original luminance of the compensation sub-pixel b is 100 nits, the compensation luminance of the compensation sub-pixel b compensating the dead sub-pixel o is 25 nits, and after the original luminance of the compensation sub-pixel b plus the compensation luminance thereof, the final display luminance of the compensation sub-pixel b is 125 nits.

It will be noted that luminance and voltage are not in a linear relationship. Therefore, if the original luminance of the compensation sub-pixel b is 50 nits, an increase in the voltage of the compensation sub-pixel b by 0.1 V may increase luminance thereof by 25 nits. However, if the original luminance of the compensation sub-pixel b is 100 nits, an increase in the voltage of the compensation sub-pixel b by 0.1 V may increase the luminance thereof by more than 25 nits. In this case, total luminance of the compensation sub-pixel b may be higher than 125 nits. Therefore, when the original luminance of the compensation sub-pixel b is 50 nits, a compensation voltage signal of the compensation sub-pixel b is 0.1 V, and when the original luminance of the compensation sub-pixel b is 100 nits, the compensation voltage signal of the compensation sub-pixel b is less than 0.1 V.

Figure 4:
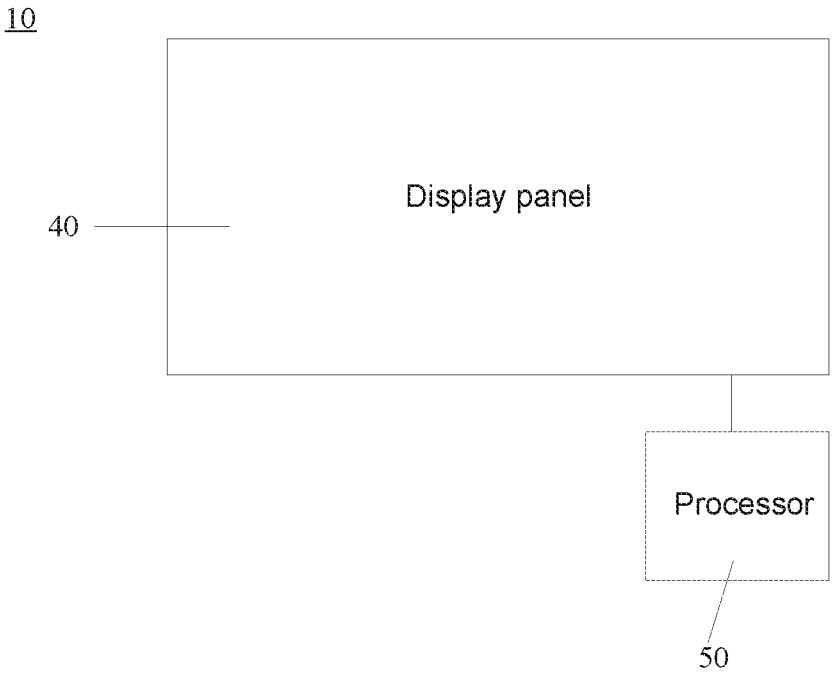
FIG. 4 is a structural diagram of yet another display apparatus, in accordance with some embodiments.

Some embodiments of the present disclosure provide a display apparatus, and as shown in FIG. 4, the display apparatus includes a display panel 40 including a plurality of sub-pixels. For example, the plurality of sub-pixels include sub-pixels of at least one color of red, green and blue. For another example, the plurality of sub-pixels include sub-pixel of at least one color of red, green, blue and white, which is not limited in some embodiments of the present disclosure. FIG. 1 only illustrates an example in which the plurality of sub-pixels in the display apparatus 10 includes red sub-pixels 101, green sub-pixels 102, and blue sub-pixels 103.

In some embodiments, the display apparatus further includes a processor 50. The processor 50 is configured to calculate a compensation data signal of each compensation sub-pixel according to a position of at least one dead sub-pixel in the display panel 40, a data signal of the at least one dead sub-pixel in the current frame image, and the number of compensation sub-pixels in all sub-pixels that have a same emission color as and are adjacent to each dead sub-pixel. The compensation sub-pixel is configured to compensate for the luminance lost by the dead sub-pixel adjacent to the compensation sub-pixel when the current frame image is displayed.

In addition, the processor 50 is further configured to: calculate a total data signal for each compensation sub-pixel according to a data signal of the compensation sub-pixel in the current frame image and the calculated compensation data signal of the compensation sub-pixel; and input the total data signal to the compensation sub-pixel when the current frame image is displayed.

In some embodiments, the display apparatus is the Micro-LED display apparatus or the electroluminescent display apparatus, and the data signal is a current signal. In some other embodiments, the display apparatus is the LCD apparatus, and the data signal is a voltage signal.

In some embodiments, in a case where the display apparatus is the Micro-LED display apparatus or the electroluminescent display apparatus, when the compensation sub-pixel compensates for luminance lost by one dead sub-pixel adjacent thereto, the compensation data signal of the compensation sub-pixel is $$\frac{A}{N}.$$

When the compensation sub-pixel compensates for luminance lost by a plurality of dead sub-pixels adjacent thereto, the compensation data signal of the compensation sub-pixel compensating for the luminance lost by each dead sub-pixel adjacent thereto is $$\frac{A}{N}.$$

The compensation data signal of the compensation sub-pixel is a sum of compensation data signals of the compensation sub-pixel compensating for the luminance lost by the plurality of dead sub-pixels adjacent thereto. Where A is a current signal of the dead sub-pixel in the current frame image, and N is the number of compensation sub-pixels that compensate for the luminance lost by the dead sub-pixel.

In some embodiments, the processor 50 may be a general-purpose central processing unit (CPU, for short), a microprocessor, an application-specific integrated circuit (ASIC, for short), or one or more integrated circuits for controlling the execution of a program.

It will be noted that when the display panel 40 displays an image and the current frame image is displayed, the processor 50 inputs the total data signal to the compensation sub-pixel, and inputs the data signal corresponding to the frame image to the other sub-pixels excluding the compensation sub-pixel and the dead sub-pixel in the plurality of sub-pixels, thereby achieving display.

Some embodiments of the present disclosure provide the display apparatus. When the display apparatus displays an image, compensation sub-pixels in all sub-pixels that have the same emission color as and are adjacent to each dead sub-pixel are used to compensate for the luminance lost by the dead sub-pixel, thereby solving the problem that the dead pixel exists in the display apparatus to affect the display, and improving the display quality of the display apparatus.

In addition, since a position of a dead point is not required to be repaired in the embodiments of the present disclosure, a repairing process is omitted, which greatly saves the repairing cost and time and simplifies the production process.

Figure 5:
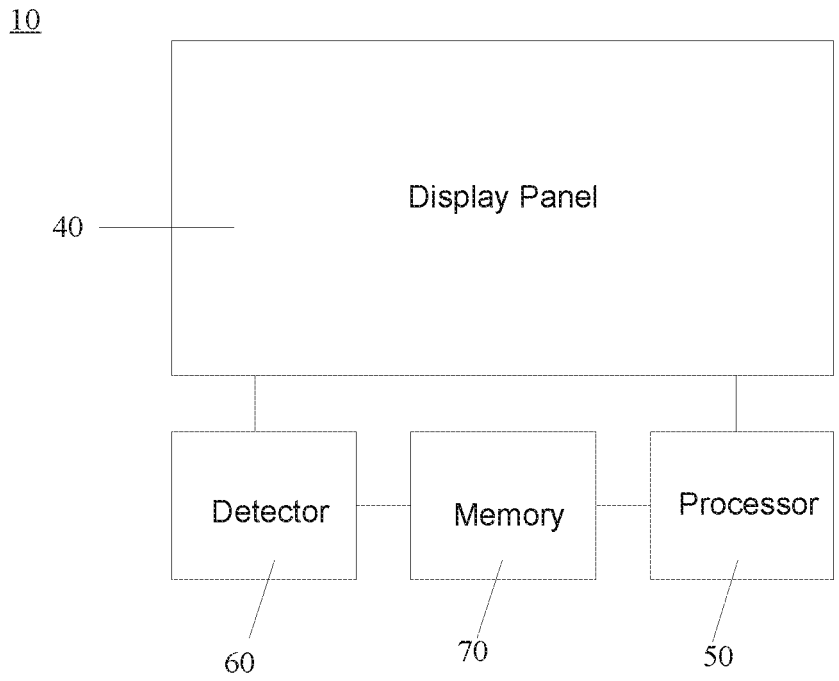
FIG. 5 is a structural diagram of yet another display apparatus, in accordance with some embodiments.

In some embodiments, as shown in FIG. 5, the display apparatus further includes a detector 60 and a memory 70. The detector 60 is configured to: detect a plurality of sub-pixels separately to determine whether each sub-pixel of the plurality of sub-pixels is able to emit light; and if not, determine that the corresponding sub-pixel is a dead sub-pixel. The memory 70 is coupled to the detector 60, and the memory 70 is configured to store the position of the dead sub-pixel.

In some embodiments, the detector 60 may include a detection circuit and a program.

On this basis, in some embodiments, the detector 60 may be integrated on a printed circuit board (PCB).

Herein, the memory 70 may be a read-only memory (ROM) or another type of static storage device that may store static information and instructions, a random access memory (RAM), or another type of dynamic storage device that may store information and instructions, or an electrically erasable programmable read-only memory (EEPROM), a compact disc read-only memory (CD-ROM) or another compact disc storage, an optical disc storage (including compressed discs, laser discs, optical discs, digital versatile discs, Blu-ray discs, etc.), a magnetic disc storage medium or another magnetic storage device, or any other medium that may be used to carry or store a desired program code in the form of instructions or data structures and can be accessed by a computer, which is not limited thereto. The memory 70 may be separate and coupled to the processor 50 via a communication line. The memory 70 may also be integrated with the processor 50.

In addition, before the detector 60 detects the plurality of sub-pixels separately, if the memory 70 has not stored the position of the dead sub-pixel, after the detector 60 detects the plurality of sub-pixels separately and the dead sub-pixel is detected, the detector 60 feeds back the position of the dead sub-pixel to the memory 70, and the memory 70 stores the position of the dead sub-pixel; if the memory 70 has stored the position of the dead sub-pixel, the detector 60 detects the plurality of sub-pixels separately, and after the memory 70 receives the position of the dead sub-pixel fed back by the detector 60, a position of a new dead sub-pixel will overwrite the position of the previous dead sub-pixel stored in the memory 70.

On this basis, there is no limitation on how the detector 60 detects the plurality of sub-pixels separately to determine whether each sub-pixel is able to emit light. In some embodiments, the display panel 40 includes a plurality of gate lines 20 and a plurality of data lines 30.

The detector 60 is configured to: input a scanning signal to the plurality of gate lines 20 row by row; and in a case where a scanning signal is input to each gate line 20 of the plurality of gate lines 20, input a detection signal to a signal input terminal of each data line 30 of the plurality of data lines 30, and detect whether a current exists on the corresponding data line 30; if a current exists, determine that a sub-pixel controlled by a corresponding gate line and a corresponding data line is able to emit light; and if no current exists, determine that the sub-pixel controlled by the corresponding gate line and the corresponding data line is not able to emit light.

In some embodiments, after the display apparatus is turned on each time, the detector 60 detects the plurality of sub-pixels separately to determine whether each sub-pixel is able to emit light.

Figure 6:
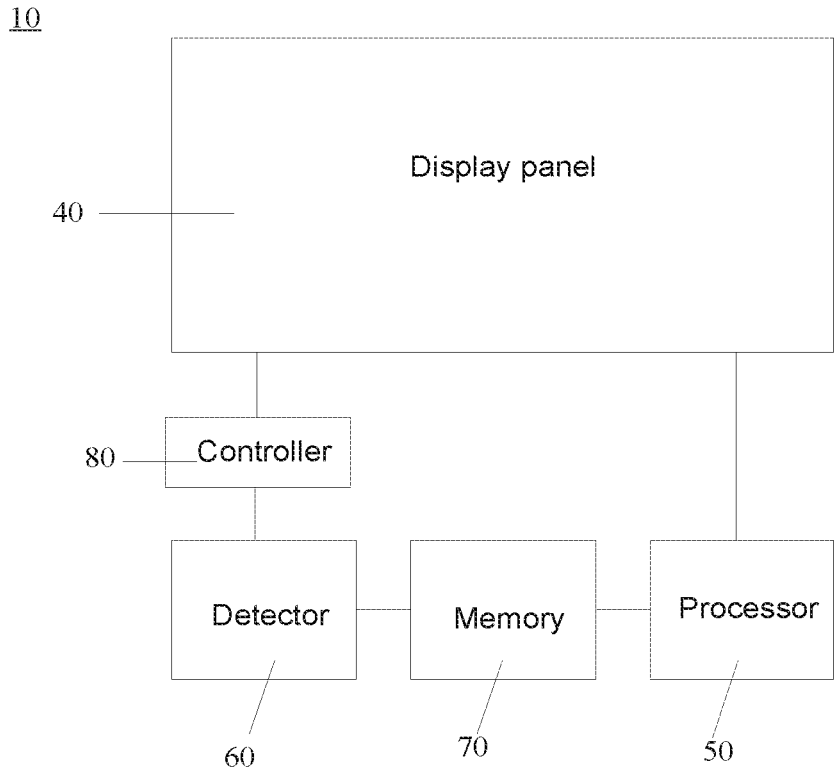
FIG. 6 is a structural diagram of yet another display apparatus, in accordance with some embodiments.

In some embodiments, as shown in FIG. 6, the display apparatus further includes a controller 80, and the controller 80 is configured to control the detector 60 to be turned on or off.

For example, the controller 80 may be a switch.

Herein, in a case where the controller 80 controls the detector 60 to be turned on, a detection function is turned on, and the detector 60 detects the plurality of sub-pixels to determine whether each sub-pixel is able to emit light; in a case where the controller 80 controls the detector 60 to be turned off, the detection function is turned off, and the detector 60 does not detect the plurality of sub-pixels.

In some embodiments, the display apparatus includes the controller 80, and the controller 80 is configured to control the detector 60 to be turned on or off. In this way, the detector 60 may be controlled to be turned on or off by the controller 80 according to user needs, thereby improving the user experience.

Some embodiments of the present disclosure provide a computer-readable storage medium (e.g. a non-transitory computer-readable storage medium). The computer readable storage medium has stored therein computer program instructions that, when executed by a processor, cause the processor to perform one or more steps in the control method of the display apparatus as described in any one of the above embodiments.

For example, the computer-readable storage medium may include, but is not limited to: a magnetic storage device (e.g. a hard disk, a floppy disk, or a magnetic tape, etc.), an optical disk (e.g. a compact disk (CD), a digital versatile disk (DVD), etc.), a smart card or a flash memory device (e.g. an erasable programmable read-only memory (EPROM), a card, a stick or a key drive, etc.). The various computer-readable storage media described in the present disclosure may represent one or more devices and/or other machine-readable storage media for storing information. The term "machine-readable storage media" may include, but are not limited to, wireless channels and various other media capable of storing, containing, and/or carrying instructions and/or data.

Some embodiments of the present disclosure further provide a computer program product. The computer program product includes computer program instructions that, when executed by a computer, cause the computer to perform one or more steps in the control method of the display apparatus as described in the above embodiments.

Some embodiments of the present disclosure further provide a computer program. When executed by a computer, the computer program causes the computer to perform one or more steps in the control method of the display apparatus as described in the above embodiments.

The computer-readable storage medium, the computer program product and the computer program have the same beneficial effects as the control method of the display apparatus as described in some embodiments of the present disclosure, which will be not described herein again.

The forgoing descriptions are merely specific implementation manners of the present disclosure, but the protection scope of the present disclosure is not limited thereto. Any person skilled in the art could conceive of changes or replacements within the technical scope of the present disclosure, which shall all be included in the protection scope of the present disclosure. Therefore, the protection scope of the present disclosure shall be subject to the protection scope of the claims.

What is claimed is:

1. A control method of a display apparatus including a plurality of sub-pixels, the control method comprising:

calculating a compensation data signal of each compensation sub-pixel according to a position of at least one dead sub-pixel adjacent to the compensation sub-pixel in the display apparatus, a data signal of each dead sub-pixel adjacent to the compensation sub-pixel in a current frame image, and a number of compensation sub-pixels in all sub-pixels that have a same emission color as and are adjacent to each dead sub-pixel, wherein the compensation sub-pixel is configured to compensate for luminance lost by the at least one dead sub-pixel adjacent thereto when the current frame image is displayed; and calculating a total data signal for the compensation sub-pixel according to a data signal of the compensation sub-pixel in the current frame image and the calculated compensation data signal of the compensation sub-pixel, and inputting the total data signal to the compensation sub-pixel when the current frame image is displayed, wherein calculating the compensation data signal of each compensation sub-pixel according to the position of at least one dead sub-pixel adjacent to the compensation sub-pixel in the display apparatus, the data signal of each dead sub-pixel adjacent to the compensation sub-pixel in the current frame image, and the number of compensation sub-pixels in all sub-pixels that have the same emission color as and are adjacent to each dead sub-pixel, includes:

in a case where the compensation sub-pixel compensates for the luminance lost by a single dead sub-pixel that is adjacent to and has the same emission color as the compensation sub-pixel, calculating the compensation data signal of the compensation sub-pixel by dividing a current signal of the single dead sub-pixel in the current frame image by the number of compensation sub-pixels that compensate for the luminance lost by the single dead sub-pixel;

in a case where the compensation sub-pixel compensates for the luminance lost by a plurality of dead sub-pixels that are adjacent to and have the same emission color as the compensation sub-pixel, for each dead sub-pixel adjacent to the compensation sub-pixel, obtaining a quotient of a current signal of the dead sub-pixel in the current frame image and the number of compensation sub-pixels that compensate for the luminance lost by the dead sub-pixel; and calculating the compensation data signal of the compensation sub-pixel by adding up quotients for the plurality of dead sub-pixels adjacent to the compensation sub-pixel;

calculating the total data signal for the compensation sub-pixel according to the data signal of the compensation sub-pixel in the current frame image and the calculated compensation data signal of the compensation sub-pixel, includes:

calculating the total data signal of the compensation sub-pixel by adding up the data signal of the compensation sub-pixel in the current frame image and the calculated compensation data signal of the compensation sub-pixel.

2. The control method according to claim 1, further comprising:

before calculating the compensation data signal of each compensation sub-pixel according to the position of at least one dead sub-pixel adjacent to the compensation sub-pixel in the display apparatus, the data signal of each dead sub-pixel adjacent to the compensation sub-pixel in the current frame image, and the number of compensation sub-pixels in all sub-pixels that have the same emission color as and are adjacent to each dead sub-pixel, detecting the plurality of sub-pixels separately to determine whether each sub-pixel of the plurality of sub-pixels is able to emit light;

if the sub-pixel is not able to emit light, determining that the sub-pixel is a dead sub-pixel, and storing a position of the dead sub-pixel.

3. The control method according to claim 2, wherein the display apparatus includes a plurality of gate lines and a plurality of data lines; and detecting the plurality of sub-pixels separately to determine whether each sub-pixel of the plurality of sub-pixels is able to emit light, includes:

inputting a scanning signal to the plurality of gate lines row by row;

when the scanning signal is input to each gate line, inputting a detection signal to a signal input terminal of each data line of the plurality of data lines, detecting whether a current exists on the data line;

if a current exists on the data line, determining that a sub-pixel controlled by the gate line and the data line is able to emit light; and if no current exists on the data line, determining that the sub-pixel controlled by the gate line and the data line is not able to emit light.

4. The control method according to claim 2, further comprising:

detecting the plurality of sub-pixels separately at a set time to obtain a position of each dead sub-pixel in the display apparatus, and updating the position of each dead sub-pixel stored previously with a position of each dead sub-pixel detected newly.

5. The control method according to claim 1, wherein the display apparatus is a micro light-emitting diode (Micro-LED) display apparatus, a mini light-emitting diode (Mini-LED) display apparatus, or an electroluminescent display apparatus; and the data signal is a current signal.

6. A non-transitory computer-readable storage medium having stored therein computer program instructions that, when executed by a processor, cause the processor to perform the control method according to claim 1.

7. A display apparatus, comprising:

a display panel including a plurality of sub-pixels; and a processor configured to:

calculate a compensation data signal of each compensation sub-pixel according to a position of at least one dead sub-pixel adjacent to the compensation sub-pixel in the display apparatus, a data signal of each dead sub-pixel adjacent to the compensation sub-pixel in a current frame image, and a number of compensation sub-pixels in all sub-pixels that have a same emission color as and are adjacent to each dead sub-pixel, wherein the compensation sub-pixel is configured to compensate for luminance lost by the at least one dead sub-pixel adjacent thereto when the current frame image is displayed;

calculate a total data signal for each compensation sub-pixel according to a data signal of the compensation sub-pixel in the current frame image and the calculated compensation data signal of the compensation sub-pixel; and input the total data signal to the compensation sub-pixel when the current frame image is displayed, wherein the processor configured to calculate the compensation data signal of each compensation sub-pixel according to the position of at least one dead sub-pixel adjacent to the compensation sub-pixel in the display apparatus, the data signal of each dead sub-pixel adjacent to the compensation sub-pixel in the current frame image, and the number of compensation sub-pixels in all sub-pixels that have the same emission color as and are adjacent to each dead sub-pixel, includes:

in a case where the compensation sub-pixel compensates for the luminance lost by a single dead sub-pixel that is adjacent to and has the same emission color as the compensation sub-pixel, the processor configured to calculate the compensation data signal of the compensation sub-pixel by dividing a current signal of the single dead sub-pixel in the current frame image by the number of compensation sub-pixels that compensate for the luminance lost by the single dead sub-pixel;

in a case where the compensation sub-pixel compensates for the luminance lost by a plurality of dead sub-pixels that are adjacent to and have the same emission color as the compensation sub-pixel, for each dead sub-pixel adjacent to the compensation sub-pixel, the processor configured to obtain a quotient of a current signal of the dead sub-pixel in the current frame image and the number of compensation sub-pixels that compensate for the luminance lost by the dead sub-pixel; and calculate the compensation data signal of the compensation sub-pixel by adding up quotients for the plurality of dead sub-pixels adjacent to the compensation sub-pixel;

the processor configured to calculate the total data signal for each compensation sub-pixel according to the data signal of the compensation sub-pixel in the current frame image and the calculated compensation data signal of the compensation sub-pixel, includes:

calculating the total data signal of the compensation sub-pixel by adding up the data signal of the compensation sub-pixel in the current frame image and the calculated compensation data signal of the compensation sub-pixel.

8. The display apparatus according to claim 7, further comprising:

a detector configured to:

detect the plurality of sub-pixels separately to determine whether each sub-pixel of the plurality of sub-pixels is able to emit light; and if the sub-pixel is not able to emit light, determine that the sub-pixel is a dead sub-pixel; and a memory coupled to the detector, the memory being configured to store a position of the dead sub-pixel.

9. The display apparatus according to claim 8, wherein the display panel includes a plurality of gate lines and a plurality of data lines; and the detector is configured to:

input a scanning signal to the plurality of gate lines row by row;

when the scanning signal is input to each gate line of the plurality of gate lines, input a detection signal to a signal input terminal of each data line of the plurality of data lines, and detect whether a current exists on the data line;

if a current exists on the data line, determine that a sub-pixel controlled by the gate line and the data line is able to emit light; and if no current exists on the data line, determine that the sub-pixel controlled by the gate line and the data line is not able to emit light.

10. The display apparatus according to claim 8, further comprising a controller configured to control the detector to be turned on or off.

* * * * *